United States Patent [19]

Back

[11] Patent Number: 4,586,262

[45] Date of Patent: May 6, 1986

[54] DOOR HINGE DUPLICATING TEMPLATE

[76] Inventor: Jack F. Back, E. 627 Empire Ave., Spokane, Wash. 99207

[21] Appl. No.: 644,791

[22] Filed: Aug. 27, 1984

[51] Int. Cl.[4] ..... B27G 17/08

[52] U.S. Cl. ..... 33/197; 33/562

[58] Field of Search ..... 33/174 G, 197, 562; 144/144.5 GT, 144.5 R, 144 R

[56] References Cited

U.S. PATENT DOCUMENTS 2,709,855 6/1955 Graham ..... 33/197
3,150,452 9/1964 Meuwissen ..... 33/197
3,789,892 2/1974 Converse et al. ..... 33/197 X
4,445,277 5/1984 Keefe ..... 144/144.5 R

*Primary Examiner*—Harry N. Haroian

[57] ABSTRACT

This door hinge duplicating template is designed to transfer an old hinge routing of one door to a new door, easily and quickly. Primarily, it consists of a face plate having a pair of attached spacer blocks, for holding the old door properly spaced from the new door that is to be routed for a hinge. It further includes a pair of insert plates, for adapting the template to be used for two hinge sizes.

1 Claim, 6 Drawing Figures

DOOR HINGE DUPLICATING TEMPLATE

This invention relates to pattern and transfer devices, and more particularly, to a door hinge duplicating template.

The principal object of this invention is to provide a door hinge duplicating template, which will be used to transfer a hinge routing from an old door to a new door.

Another object of this invention is to provide a door hinge duplicating template, which will be of great help to the layman or carpenter who is doing remodeling work, and the device has been shop-tested and should be a useful and handy device for anyone's tool collection.

A further object of this invention is to provide a door hinge duplicating template, which will be preferably fabricated of one-quarter inch aluminum plate, or other suitable metal for durability.

Other objects are to provide a door hinge duplicating template, which is simple in design, inexpensive to manufacture, rugged in construction, easy to use, and efficient in operation.

These, and other objects, will be readily evident, upon a study of the following specification, and the accompanying drawing, wherein.

Figure 1:
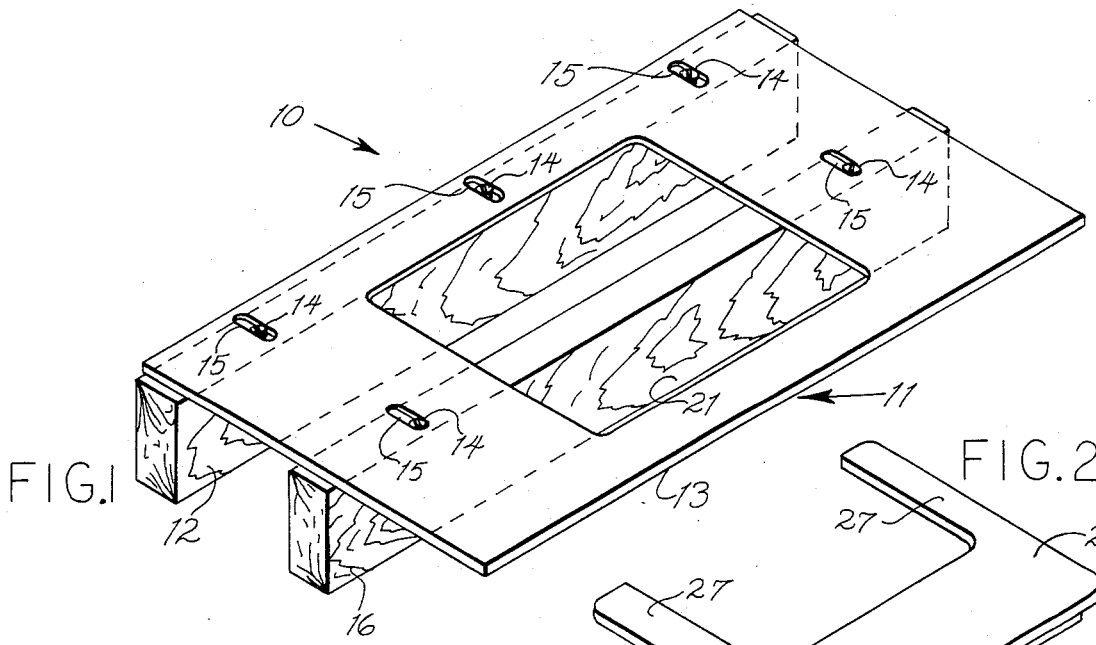
FIG. 1 is a perspective view of the present invention.
Figure 2:
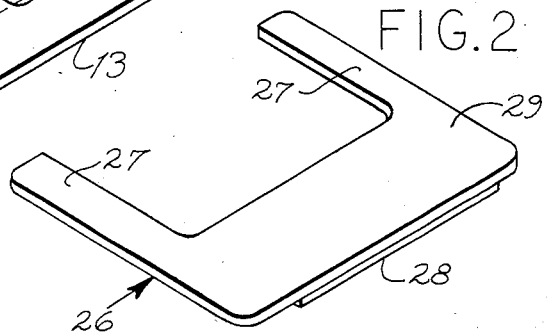
FIG. 2 is a perspective view of an insert used with the invention.
Figure 3:
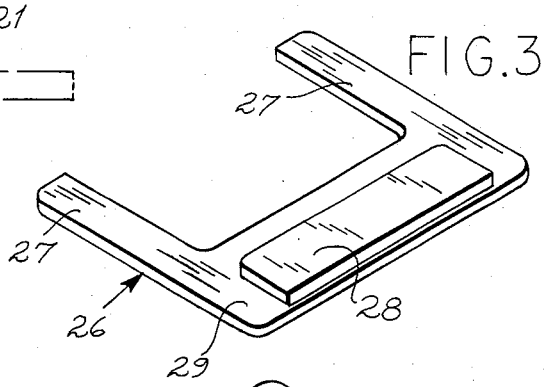
FIG. 3 is a bottom perspective view of FIG. 2.
Figure 4:
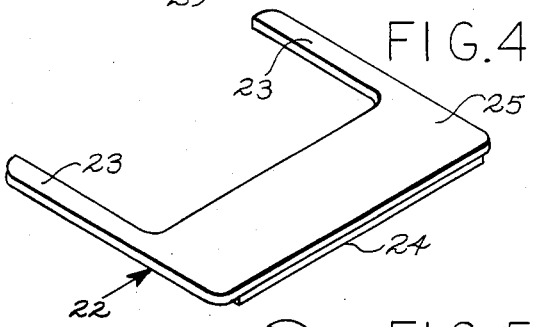
FIG. 4 is similar to FIG. 2, but shows a modified form of insert.
Figure 5:
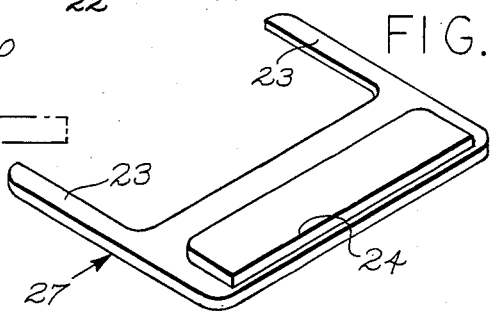
FIG. 5 is a bottom perspective view of FIG. 4.
Figure 6:
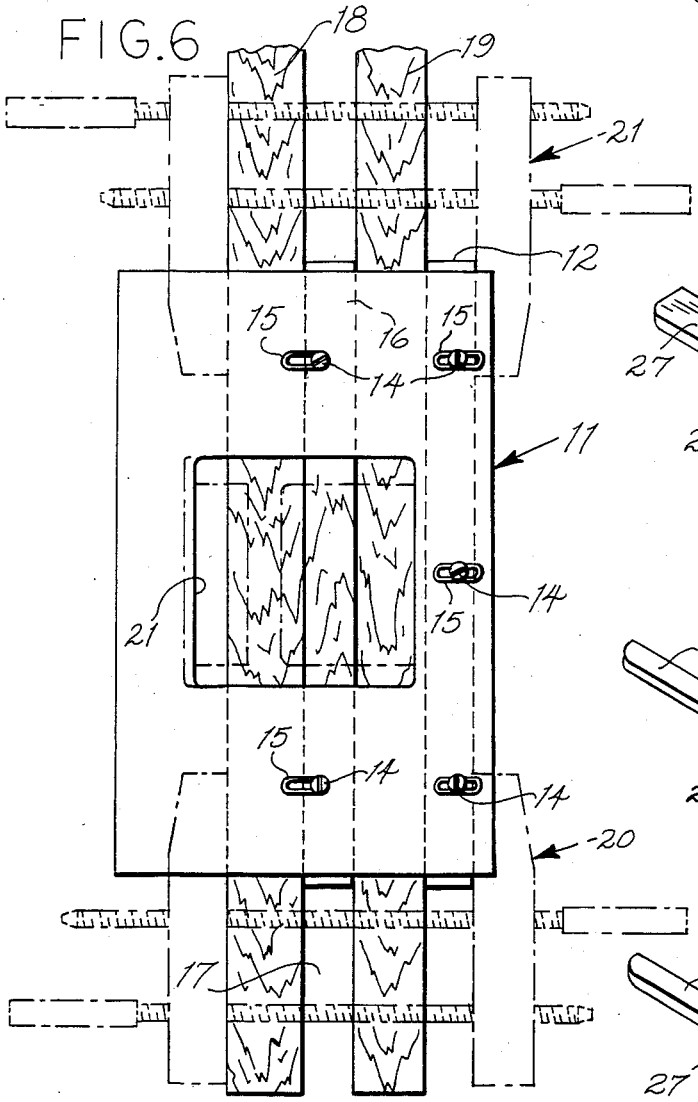
FIG. 6 is a top plan view of the invention, illustrated in use.

Accordingly, a template 10 is shown to include a face plate 11 of rectangular configuration, having a stationary spacer block 12 of wood, or other suitable material, secured to its bottom surface 13, by three screw fasteners 14, which are received in spaced elongated openings 15 through plate 11. A floating spacer block 16 is also included, and fastened to the bottom surface 13 of face plate 11 by similar openings 15 through plate 11, and the floating spacer block 16 defines a three-quarters of an inch space 17 between the new door 18 and the old door 19, when template 10 is clamped in place on spacer blocks 12 and 16, by means of clamps 20. A large square opening 21 is provided through plate 11, so as to enable the user to route a space accurately to fit a four and one-half inch hinge. These routings are made by inserting a one-half inch template guide bushing with a one-half inch outside dimension, on the router.

An insert plate 22 is provided, for insertion into opening 21 of face plate 11, and includes a pair of spaced legs 23 and an aligner plate 24, which is fixedly secured to one side of its main body portion 25, in a suitable manner.

A second insert plate 26 is also provided, for insertion into opening 21 of face plate 11, and also includes a pair of spaced legs 27 and an aligner plate 28, which is secured to one side of its main body portion 29, and insert plates 22 and 26 are used for a purpose which hereinafter will be described.

In use, the new door 19 and the old door 18 must be aligned side by side, on their edges, and even with each other on the top. The template 10 is then laid across the doors 19 and 18, after which, face plate 11 is adjusted with the stationary spacer block 12, so that the new hinge route will be set in across the same distance as the old one. The floating spacer block 16 thus forms a three-quarter inch space between the new door 19 and the old door 18, when clamped in place by clamps 20. The large opening 21, in face plate 11, will now accurately route a space to fit a four and one-half inch hinge. The insert 22 is then placed in opening 21, with its aligner plate 24 in the old hinge route, and then everything is set for the routing for the new hinge on the new door 19.

It shall be noted, that the insert plate 26 is used in the same manner as above described, but is employed for a three and one-half inch hinge route.

While various changes may be made in the detail construction, it is understood that such changes will be within the spirit and scope of the present invention, as is defined by the appended claims.

I claim:

1. A door hinge duplicating template, comprising, in combination, a face plate, a stationary spacer block secured to a bottom surface of said face plate, and a floating spacer block also securable to said face plate bottom surface, a plurality of elongated openings through said face plate receiving screw fasteners screwed in both said spacer blocks, a space between said stationary spacer block and said floating spacer block for a new door being positioned therebetween, a large square opening through said face plate to route out an accurate space for fitting a hinge, a pair of insert plates inserted one at a time in said large square opening, each of said insert plates comprising a main body portion and a pair of spaced apart legs extending from said main body portion and an align plate affixed to one side of said main body portion for placement in an old hinge route of an old door, so that a new hinge route on siad new door will be set across the same distance as on said old door which is held clamped together with said spacer blocks and new door.

* * * * *